US007074076B2

(12) United States Patent
Richter

(10) Patent No.: US 7,074,076 B2
(45) Date of Patent: Jul. 11, 2006

(54) ELECTRICAL MINIPLUG CONNECTOR

(75) Inventor: Michael Richter, Schalksmühle (DE)

(73) Assignee: Lumberg Connect GmbH & Co. KG, Schalksmuhle (DE)

( * ) Notice: Subject to any disclaimer, the term of this patent is extended or adjusted under 35 U.S.C. 154(b) by 0 days.

(21) Appl. No.: 11/001,697

(22) Filed: Dec. 1, 2004

(65) Prior Publication Data

US 2005/0130461 A1 Jun. 16, 2005

(30) Foreign Application Priority Data

Dec. 10, 2003 (DE) ..... 103 58 078

(51) Int. Cl.
*H01R 12/24* (2006.01)

(52) U.S. Cl. ..... 439/499

(58) Field of Classification Search ..... 439/397, 439/733.1, 499, 607, 353, 354, 660
See application file for complete search history.

(56) References Cited

U.S. PATENT DOCUMENTS 5,129,840 A * 7/1992 Kuzuno et al. ..... 439/397
6,457,997 B1 * 10/2002 Fan ..... 439/660

FOREIGN PATENT DOCUMENTS

| | | |
|---|---|---|
| DE | 101 04 288 | 4/2002 |
| DE | 10104288 | 4/2002 |
| EP | 0820123 | 10/1998 |
| EP | 0871261 | 10/1998 |

* cited by examiner

*Primary Examiner*—Phuong Dinh
(74) *Attorney, Agent, or Firm*—Andrew Wilford

(57) ABSTRACT

An electrical miniplug has a dielectric body formed with an upper array of coplanar seats and a lower array of seats interleaved with the upper seats and lying in a lower plane offset from the upper-seat plane. Respective upper contacts are each unitarily formed with a flat mounting region lying in a respective one of the upper seats on the upper mounting plane, a rear contact end projecting rearwardly from the respective mounting region, and a front contact end projecting forwardly from the respective mounting region. Respective lower contacts are each unitarily formed with a flat mounting region lying in a respective one of the lower seats on the lower mounting plane, a rear contact end projecting rearwardly from the respective mounting region, and a front contact end projecting forwardly from the respective mounting region. All of the front contact ends lie on a common contact plane.

12 Claims, 5 Drawing Sheets

ELECTRICAL MINIPLUG CONNECTOR

FIELD OF THE INVENTION

The present invention relates to an electrical connector. More particularly this invention concerns a so-called miniplug for connecting a large number of conductors to a small multicontact socket.

BACKGROUND OF THE INVENTION

A typical electrical miniplug assembly as described in German patent 101 04 288 of Richter has a dielectric plug body and a row of plug contacts fixed to the body and each unitarily formed with a flat mounting region lying on the body, a rear contact end projecting rearwardly from the respective mounting region, a front contact end projecting forwardly from the respective mounting region. A metallic plug shell surrounds the plug body and the contact ends of the contacts. A socket for such an assembly has a dielectric socket body, a row of socket contacts fixed to the socket body, and a metallic socket shell into which the plug body, plug shell, and the contact ends of the plug contacts are fittable to engage the plug contacts with the socket contacts. The shells of the plug and socket fit together in a position with the plug contacts bearing on the socket contacts to form a multiplicity of electrical connections.

In order to hold the plug in the socket, the plug shell has a broad face from which project a pair of bumps formed by strips punched out of this broad face. The socket is formed on the broad face of its shell with a pair of complementary through going holes in which the bumps engage when the plug is inserted fully into the socket, the bumps being elastically inwardly deflected during insertion, and again during removal.

A significant problem with such a connector assembly is seen with today's small pieces of electronic equipment, such as for example cell phones. The small format of the equipment requires a so-called miniplug connector that, in spite of its small dimensions, must have a large-number of contacts in order to communicate information accurately between the equipment and, for example, a programming computer. As the size of the standard flat plug is decreased it is of course necessary to shrink the width of the connectors, normally formed as small metal strips mounted flat and arranged to be deflected transversely to their planes. To get enough contacts into a small enough connector, it is desired to set them on spacing of about 1 mm, which requires that the contacts be a mere 0.5 mm in width. Such a narrow contact is extremely fragile so that the connector can readily be damaged.

A further difficulty lies in that the latch formations that secure the plug and socket together present surfaces that can snag on things. For instance if the connector cable or telephone is put in a pocket, the latch formation can catch on the pocket's lining.

OBJECTS OF THE INVENTION

It is therefore an object of the present invention to provide an improved miniplug electrical connector assembly.

Another object is the provision of such an improved miniplug electrical connector assembly that overcomes the above-given disadvantages, in particular that allows a large number of conductors to be packed into a small connector assembly.

A further object is to provide an improved latch system for such a miniplug connector assembly.

SUMMARY OF THE INVENTION

An electrical miniplug assembly has according to the invention a dielectric body formed with an upper array of upper seats lying in an upper mounting plane and a lower array of lower seats interleaved with the upper seats and lying in a lower mounting plane substantially parallel to but offset from the upper mounting plane. Respective upper contacts are each unitarily formed with a flat mounting region lying in a respective one of the upper seats on the upper mounting plane, a rear contact end projecting rearwardly from the respective mounting region, and a front contact end projecting forwardly from the respective mounting region. Respective lower contacts are each unitarily formed with a flat mounting region lying in a respective one of the lower seats on the lower mounting plane, a rear contact end projecting rearwardly from the respective mounting region, and a front contact end projecting forwardly from the respective mounting region. In accordance with the invention all of the front contact ends lie on a common contact plane.

Providing the contacts in two rows (although of course it is within the scope of the invention to use three or more rows) allows all the parts of the contacts other than the contact ends to be built somewhat wider. In this manner the contacts can be made relatively rugged, while still allowing the contact ends to be tightly spaced.

According to the invention the contact plane is generally level with the upper mounting plane and each of the lower contacts has a connecting portion extending transversely of the planes between the respective mounting region and the respective contact end. Furthermore each of the contacts is substantially narrower at its contact end than at its mounting region. More particularly, the contacts taper forward from the respective mounting regions. Each of the lower contacts has a tapered connecting portion extending transversely of the planes between the respective mounting region and the respective contact end. In this manner, when the contact ends are transversely separated in the contact plane by a predetermined spacing, the mounting regions can have widths generally equal to the spacing. Obviously if contacts of this width were placed next to each other they would touch and short circuit, but stacking them according to the invention keeps them apart.

In according to with a further feature of the invention the connector ends of the lower contacts lie in a lower contact plane offset from the upper mounting plane. Thus each of the lower contacts has a-connecting portion extending transversely of the planes between the respective mounting region and the respective connector end. The lower mounting plane is between the lower contact plane and the upper mounting plane and the lower contact plane is spaced farther from the lower mounting plane than the upper mounting plane. This makes it possible to provide fairly substantial contact ends on the conductors in spite of their tight spacing. In other words the contacts are only directly next to each other at their front contact ends. Otherwise the lower contacts are wholly below the upper contacts.

To further facilitate connecting to the contacts, the connector ends of the upper contacts project from the respective mounting portions by a distance that is different from a distance the connector ends of the lower contacts project from the respective mounting portions.

According to another feature of the invention the miniplug has a metallic shell surrounding the body and the contact ends of the upper and lower contacts. This shell is formed unitarily with a strip connected at both ends to the shell and centrally formed with an outwardly projecting bump. A socket has a row of socket contacts engageable with the upper and lower contacts and a metallic shell into which the dielectric body and the contact ends of the upper and lower contacts is engageable and which is formed with a punched-out tab defining a throughgoing hole in which the bump is engageable when the miniplug is fitted to the socket and over which the tab extends. Thus the tab covers the hole when the connector is assembled, protecting the latch formation of the plug. Furthermore this tab eliminates a possible site of snagging of the connector.

In this arrangement the shells each have a wide flat portion extending parallel to the respective rows of contacts and a pair of narrow edge portions extending perpendicular to the respective wide portion. Both of the edge portions of the plug shell are formed with such a strip and bump and both of the edge portions of the socket shell are formed with such a hole and tab. Thus the plug will be solidly gripped on both sides so that it will hold in the socket.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
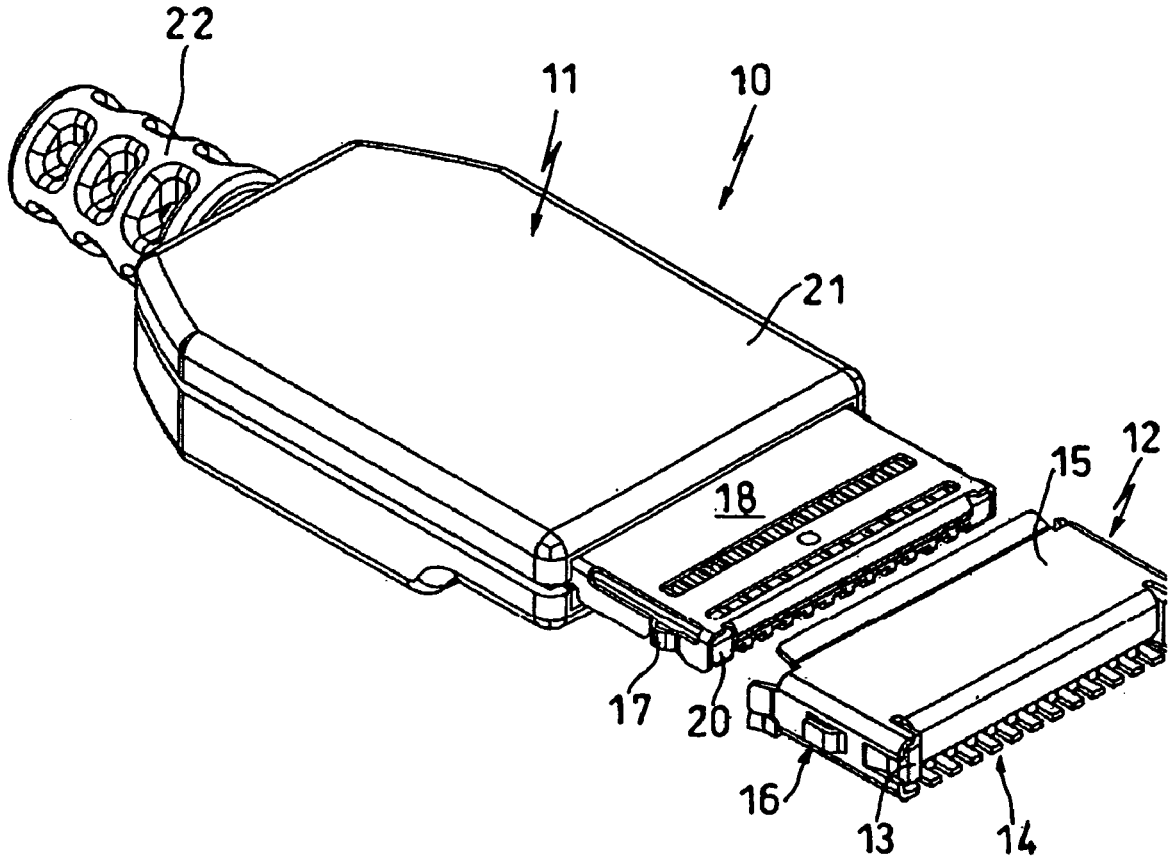
FIG. 1 is a perspective view of the miniplug connector assembly according to the invention
Figure 3:
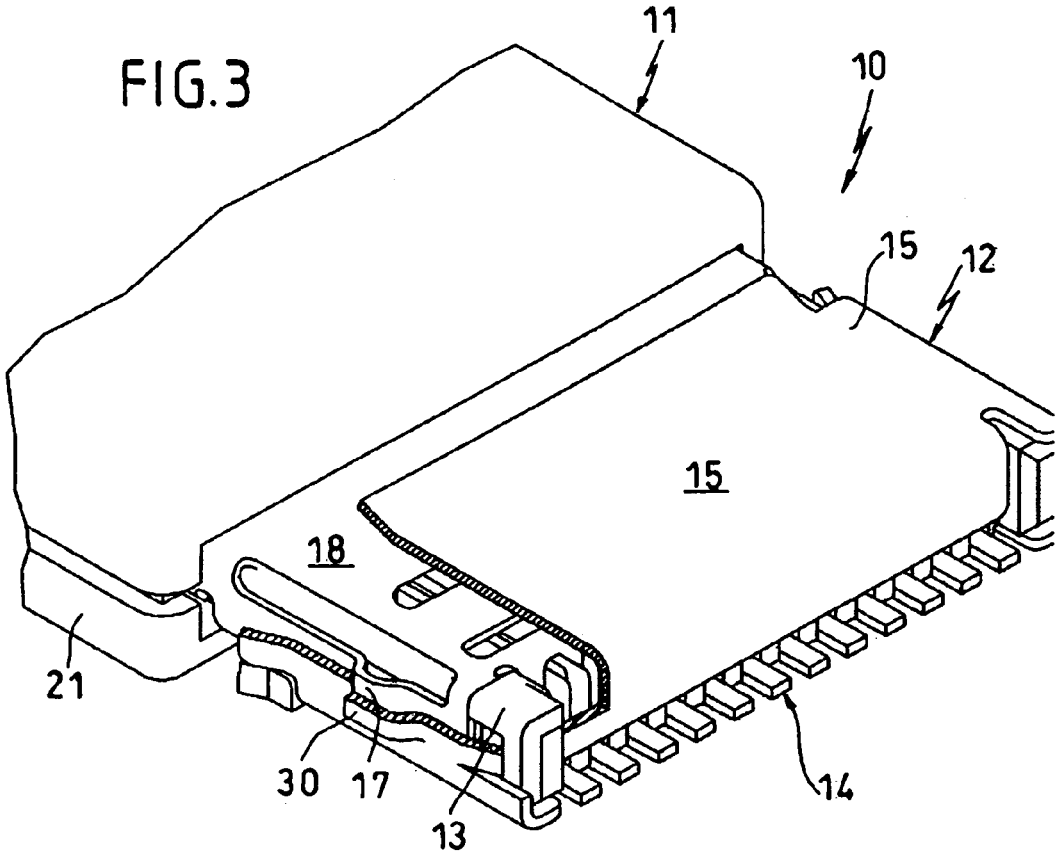
FIG. 3 is a view of the structure of FIG. 1, partly broken away and with the miniplug fitted to its socket.
Figure 2:
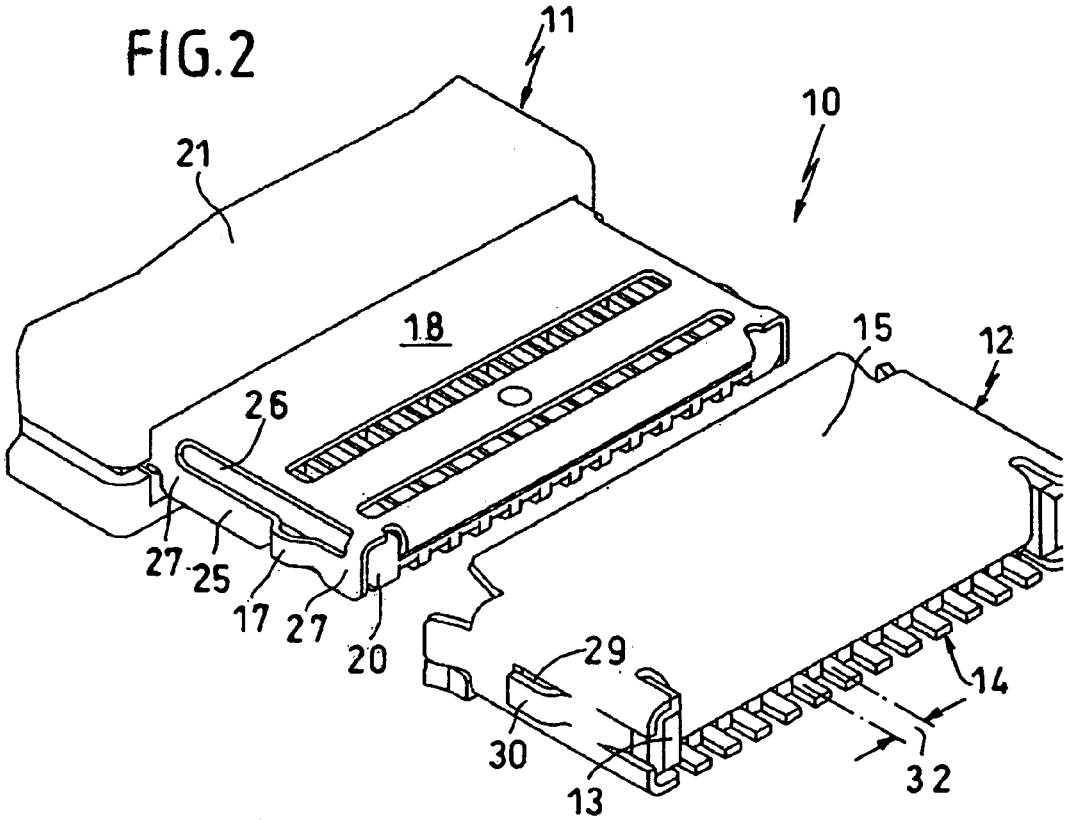
FIG. 2 is a large-scale view of the right-hand elements of the FIG. 1 structure.
Figure 4:
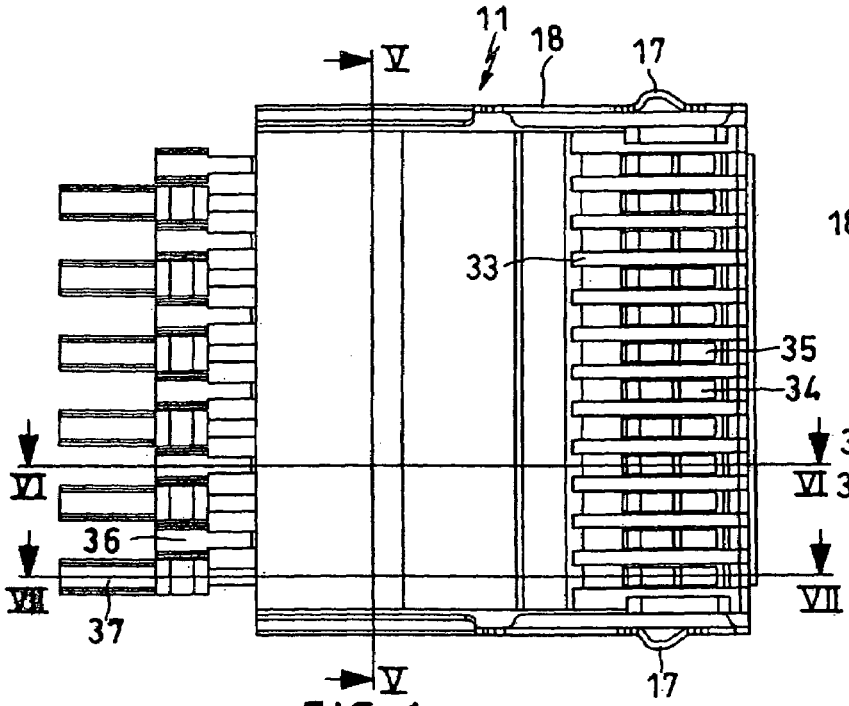
FIG. 4 is a large-scale sectional top view of the miniplug in accordance with the invention.

As seen in FIGS. 1, 2, and 3, a connector assembly 10 comprises a miniplug 11 adapted to be mounted at the end of an unillustrated multiconductor cable and a complementary socket 12 normally mounted on a piece of small electronic equipment such as a cell phone, notebook computer, or camera. The socket 12, which is standard, has a plastic body 13 holding a straight row of tightly spaced contacts 14 whose SMD mounting feet are visible in FIG. 1. These contacts 14 are at a very tight spacing 32 (FIG. 2) of about 1 mm on center. A metal shell 15 on the plastic body 13 has a pair of latching formations or tabs 16 described in more detail below. The miniplug 11 has a plastic body 21 from which a strain relief 22 holding the unillustrated cable extends rearward and a metal sleeve 18 having latching formations 17 cooperating with the formations 16 projects forward from the body 21.

As shown in FIGS. 4–7, the plug 11 has a dielectric plastic body 33 on which are mounted a row of contacts 34 and 35 in respective seats 19 and 23. The contacts 34 are all identical and alternate with the contacts 35 that are also identical but different from the contacts 34. These contacts 34 and 35 are all made of conductive sheet metal and sit flatly on a front end portion 20 of the plug body 33. They have respective rear connector ends 36 and 37, central mounting regions 38 and 39, and front contact ends 40 and 41.

Figure 6:
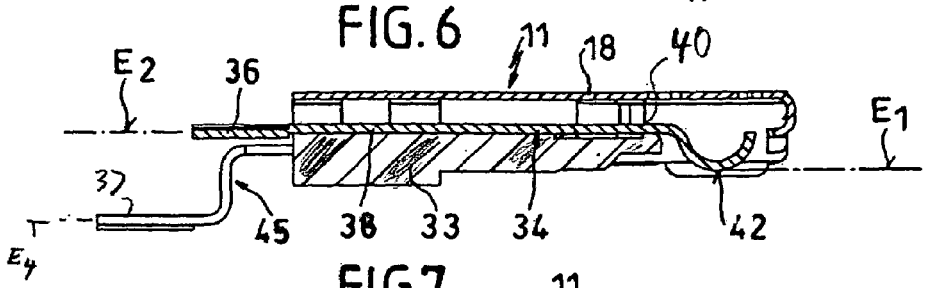
Figure 7:
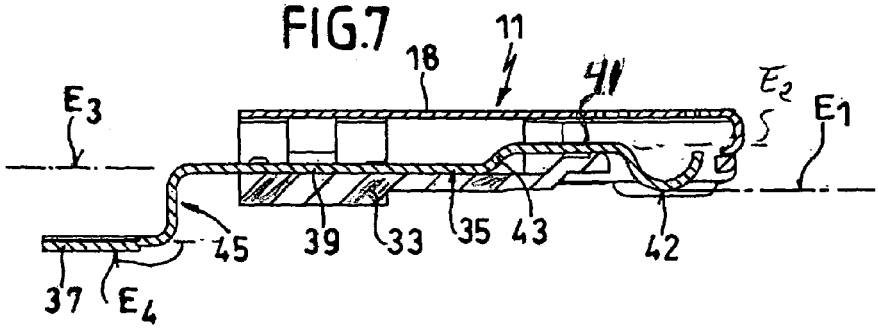
Figure 10:
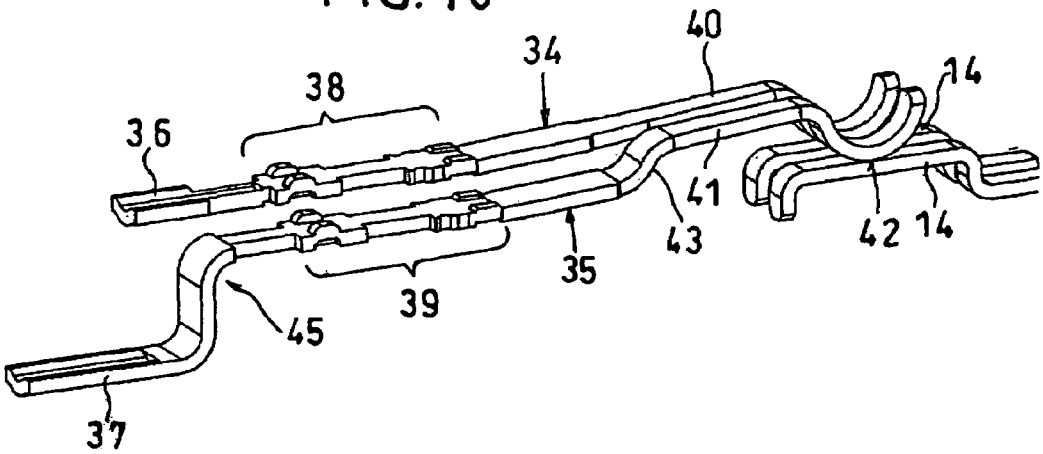
FIG. 10 is a perspective view of the conductors of FIGS. 8 and 9.
Figure 9:
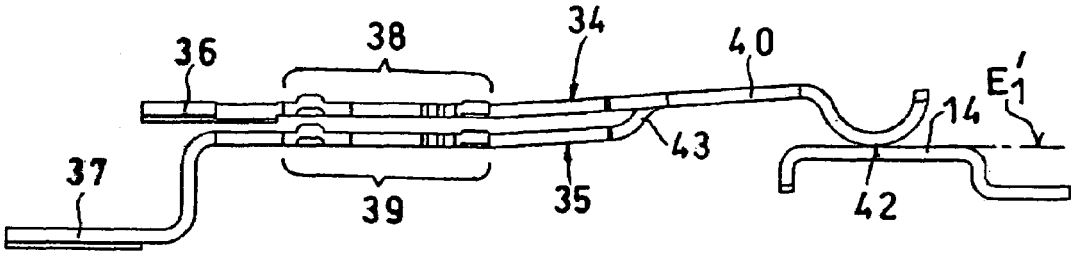
FIG. 9 is a side view of the conductors of FIG. 8.

These ends 40 and 41 in turn form contact feet 42 adapted to bear as shown in FIGS. 9 and 10 on the respective conductors 14 of the socket 12. When not fitted in the socket 12, the contact feet 42 tangent as shown by FIGS. 6 and 7 a plane $E_1$, but when fitted to the socket 12 these contact feet 42 are deflected elastically upward as shown by FIG. 9 to a plane $E'_1$. Thus when the plug 11 is inserted into the socket 12 the contact feet 42 bear elastically on the respective conductors 14.

Figure 5:
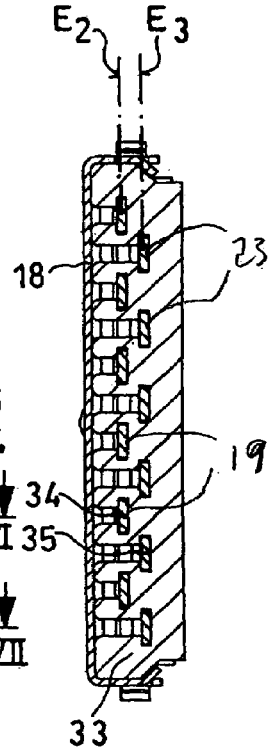
FIGS. 5, 6, and 7 are sections taken along respective lines V—V, VI—VI, and VII—VII of FIG. 4.

The mounting regions 38 of the contacts 34 lie as shown in FIGS. 5 and 6 in seats 19 on the body 33 in a common plane $E_2$ with their contact ends 40 and with their connector ends 36. Thus these contacts 34 are essentially planar and flat except for their contact feet 42.

As shown in FIGS. 5 and 7, the mounting regions 39 of the contacts 35 lie on a plane $E_3$ below the plane $E_2$ in the seats 23 formed in the body 33. To this end these contacts 35 are formed with angled parts or offsets 43 that connect their mounting regions 39 with their contact ends 40. Thus these contact ends 41 lie on the plane $E_2$ and are coplanar with the mounting regions 38 of the contacts 34. The rear connector ends 37 of the contacts 35, however, are connected by transverse webs 45 with the respective mounting regions 39 so as to lie in a plane $E_4$ well below the planes $E_1$, $E_2$, and $E_3$. In addition these connector ends 37 project rearward well past the connector ends 36.

Figure 8:
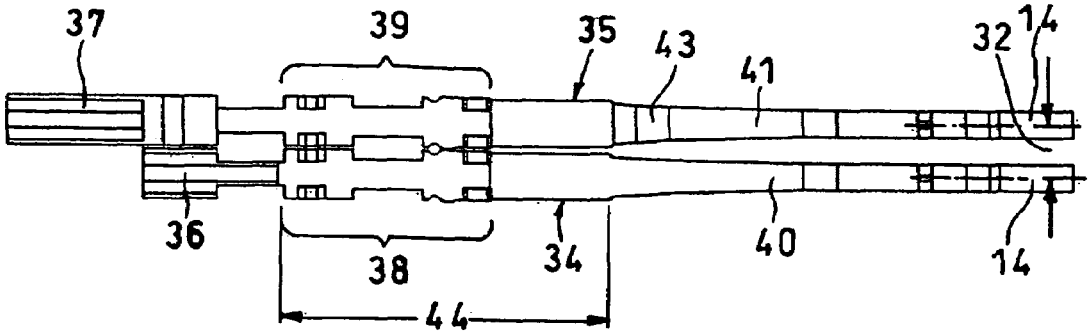
FIG. 8 is a top view of two adjacent conductors of the miniplug.

The offsets of the planes $E_2$, $E_3$, and $E_4$ have two main advantages. As shown in FIGS. 8, 9, and 10, they make it possible for the contacts 34 and 35 to be relatively wide in a central region 44 mainly defined by the mounting regions 38 and 39, and in fact in this region 44 they can have a width virtually equal to the contact spacing 32, since the portions 38 are not coplanar with the portions 39. From this central region 44 the contacts 34 and 35 taper forward to their contact ends 40 and 41 which have a width equal to about half of the spacing 32. Thus the contacts 34 and 35 will be physically big enough where they are fixed in the body 33 to be strong and stable, but still will be narrow and flexible at their contact ends 40 and 41.

In addition the planar offset at the connector ends 36 and 37 allows these parts to be secured in SMD manner or as spade lugs to the circuit element they are attached to without a danger of short-circuiting between adjacent contacts 34 and 35. As a result, in spite of the dense juxtaposition of the contacts 34 and 35, connecting to them will be possible using standard-size parts in the plug 11 while the contacts 14 inside the socket 12 can be very tightly packed.

Figure 11:
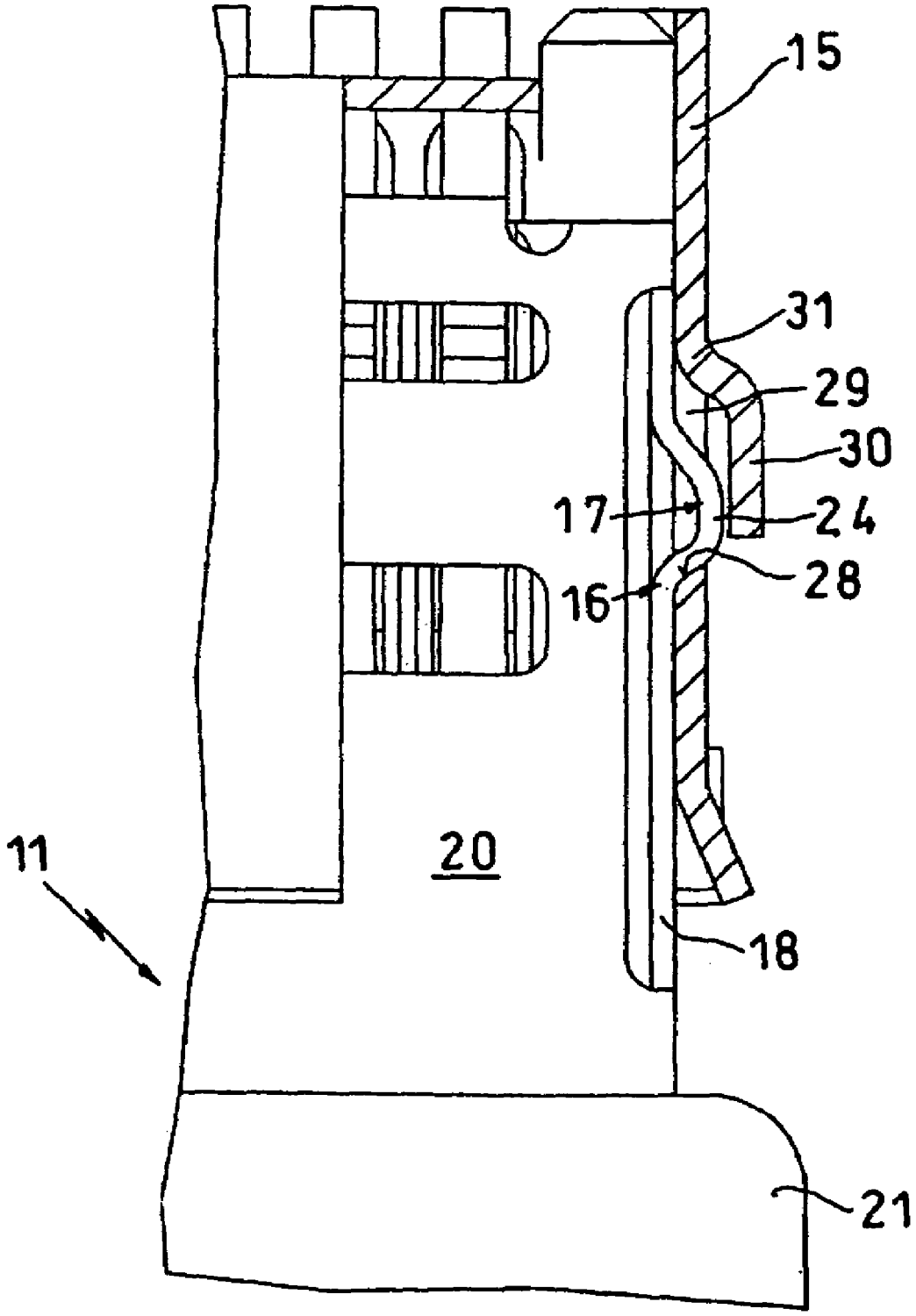
FIG. 11 is a large-scale sectional view illustrating how the miniplug of this invention fits with its socket.

As best shown in FIGS. 1, 2, and 11 the latching formation 17 of the plug 11 is formed as a bump 24 in a metal strip 25 defined by a slot 26 cut in each of the narrow edges of the U-shaped metal sleeve 18 of the plug 11. Front and rear ends 27 of the strip 25 are unitarily joined to the sleeve 18, and the bump 24 is formed by permanent plastic deformation of the strip 25, imparting quite some stiffness to the strip 25. Thus the outer surfaces of the plug 11 are all relatively smooth, with the bump 17 presenting no hook or edge that could get caught on something and lead to fouling or damage of the plug 11.

The latching formation 16 of the socket 12 is formed by a tab 30 punched out of the narrow side of the sleeve 15, left joined to it at a front end 31, and forming a hole 29 having an outer edge 28. When the plug 11 is pushed into the socket 12, the two bumps 24 will be deflected elastically inward toward each other until they engage in the holes 29, whereupon they will snap out and bear against the rear edge 28, solidly holding the plug 11 in the socket 12. The tab 30 covers almost the entire hole 29 so that it protects the bump 29 therein.

I claim:

1. An electrical miniplug assembly conprising:

a dielectric body formed with an upper array of upper seats lying in an upper mounting plane and a lower array of lower seats interleaved with the upper seats and lying in a lower mounting plane substantially parallel to but offset from the upper mounting plane;

respective longitudinally extending upper contacts each unitarily formed with a wide flat mounting region lying in a respective one of the upper seats on the upper mounting plane and having a predetermined transverse width measured parallel to the planes, a rear contact end projecting rearwardly from the respective mounting region, and a narrow front contact end projecting forwardly from the respective mounting region; and respective longitudinally extending lower contacts each unitarily formed with a wide flat mounting region lying in a respective one of the lower seats on the lower mounting plane and having the predetermined transverse width measured parallel to the planes;

a rear contact end projecting rearwardly from the respective mounting region, and a narrow front contact end projecting forwardly from the respective mounting region, all of the front contact ends being spaced apart by the predetermined width and lying on a common contact plane parallel to one of the mounting planes.

2. The electrical miniplug assembly defined in claim 1 wherein the contact plane is generally level with the upper mounting plane and each of the lower contacts has a connecting portion extending transversely of the planes between the respective mounting region and the respective contact end.

3. The electrical miniplug assembly defined in claim 1 wherein the contacts taper forward from the respective mounting regions.

4. The electrical miniplug assembly defined in claim 4 wherein each of the lower contacts has a tapered connecting portion extending transversely of the planes between the respective mounting region and the respective contact end.

5. The electrical miniplug assembly defined in claim 1 wherein the rear contact ends of the lower contacts lie in a lower contact plane offset from the upper mounting plane.

6. The electrical miniplug assembly defined in claim 5 wherein each of the lower contacts has a connecting portion extending transversely of the planes between the respective mounting region and the respective connector end.

7. The electrical miniplug assembly defined in claim 6 wherein the lower mounting plane is between the lower contact plane and the upper mounting plane.

8. The electrical miniplug assembly defined in claim 7 wherein the lower contact plane is spaced farther from the lower mounting plane than the upper mounting plane.

9. The electrical miniplug assembly defined in claim 1 wherein the connector ends of the upper contacts project from the respective mounting portions by a distance that is different front a distance the connector ends of the lower contacts project from the respective mounting portions.

10. The electrical miniplug assembly defined in claim 1 wherein the miniplug has a metallic shell surrounding the body and the contact ends of the upper and lower contacts, the shell being formed unitarily with a strip connected at both ends to the shell and centrally formed with an outwardly projecting bump, the assembly further comprising a socket having:

a row of socket contacts engageable with the upper and lower contacts; and a metallic shell into which the dielectric body and the contact end of the upper and lower contact is engageable and formed with a punched-out tab defining a throughgoing hole in which the bump is engageable when the miniplug is fitted to the socket and over which the tab extends.

11. An electrical miniplug assembly comprising:

a dielectric plug body;

a row of plug contacts fixed to the body and each unitarily formed with a flat mounting region lying on the body, a rear contact end projecting rearwardly from the respective mounting region, and a front contact end projecting forwardly from the respective mounting region;

a metallic plug shell surrounding the plug body and the contact ends of the contacts, the plug shell being formed unitarily with a strip connected at both ends to the plug shell and centrally formed with an outwardly projecting bump;

a dielectric socket body;

a row of socket contacts fixed to the socket body; and a metallic socket shell into which the plug body, plug shell, and the contact ends of the plug contacts are fittable to engage the plug contacts with the socket contacts, the socket shell being formed with a punched-out tab defining a throughgoing hole in which the bump is engageable when the plug body is fitted to the socket shell and over which the tab extends.

12. The electrical miniplug assembly defined in claim 11 wherein the shells each have a wide flat portion extending parallel to the respective rows of contacts and a pair of narrow edge portions extending perpendicular to the respective wide portion, both of the edge portions of the plug shell being formed with such a strip and bump and both of the edge portions of the socket shell being formed with such a hole and tab.

* * * * *